United States Patent [19]

Biebuyck

[11] 4,055,923

[45] Nov. 1, 1977

[54] WALL FRAMING SYSTEM AND COMPONENTS THEREOF

[75] Inventor: Lawrence F. Biebuyck, Dallas, Tex.

[73] Assignee: Howmet Corporation, New York, N.Y.

[21] Appl. No.: 628,158

[22] Filed: Nov. 3, 1975

Related U.S. Application Data

[63] Continuation-in-part of Ser. No. 560,820, March 21, 1975, Pat. No. 4,008,552, which is a continuation of Ser. No. 378,321, July 11, 1973, abandoned.

[51] Int. Cl.[2] ..... E04B 2/88

[52] U.S. Cl. ..... 52/235; 52/397; 52/302

[58] Field of Search ..... 52/61, 62, 731, 235, 52/495, 302, 303, 209, 399, 398, 397

[56] References Cited

U.S. PATENT DOCUMENTS

| | | | |
|---|---|---|---|
| 2,885,040 | 5/1959 | Grossman | 52/235 |
| 2,963,126 | 12/1960 | Cudini | 52/302 |
| 3,052,330 | 9/1962 | Hammitt | 52/235 |
| 3,057,444 | 9/1962 | Walberg | 52/235 |
| 3,093,217 | 6/1963 | Doede | 52/397 |
| 3,121,482 | 2/1964 | Cobb | 52/235 |
| 3,266,207 | 8/1966 | Birum | 52/495 |
| 3,266,210 | 8/1966 | Grossman | 52/235 |
| 3,357,144 | 12/1967 | Chauveau | 52/235 |
| 3,488,906 | 1/1970 | Brooks | 52/235 |
| 3,734,550 | 5/1973 | Vance | 52/303 |
| 3,940,897 | 3/1976 | Stoakes | 52/235 |

*Primary Examiner*—John E. Murtagh
*Attorney, Agent, or Firm*—Thomas L. Cantrell; Joseph H. Schley

[57] ABSTRACT

Disclosed is a wall framing system having vertical and horizontal mullions each formed of an interior piece and an exterior piece connected together by internal plastic clips. Water diverters are mounted internally of the horizontal mullions for diverting intruded water to exit points on the exterior sides of the mullions. At the crossings of vertical and horizontal mullions, internal water diverter bridge pieces connect through the vertical mullions from the water diverter in one horizontal mullion to the water diverter in the other. The vertical mullion faces each have a height substantially equal to a coextensive with the panels they grip to facilitate glazing and reglazing. A special open channel horizontal mullion with joint forming flanges therein is disclosed, together with a novel snap lock cover system therefor. Installation of the wall system is facilitated by deep glazing pocket vertical jambs, the two piece vertical mullions, and assymetrical glazing gaskets.

13 Claims, 21 Drawing Figures

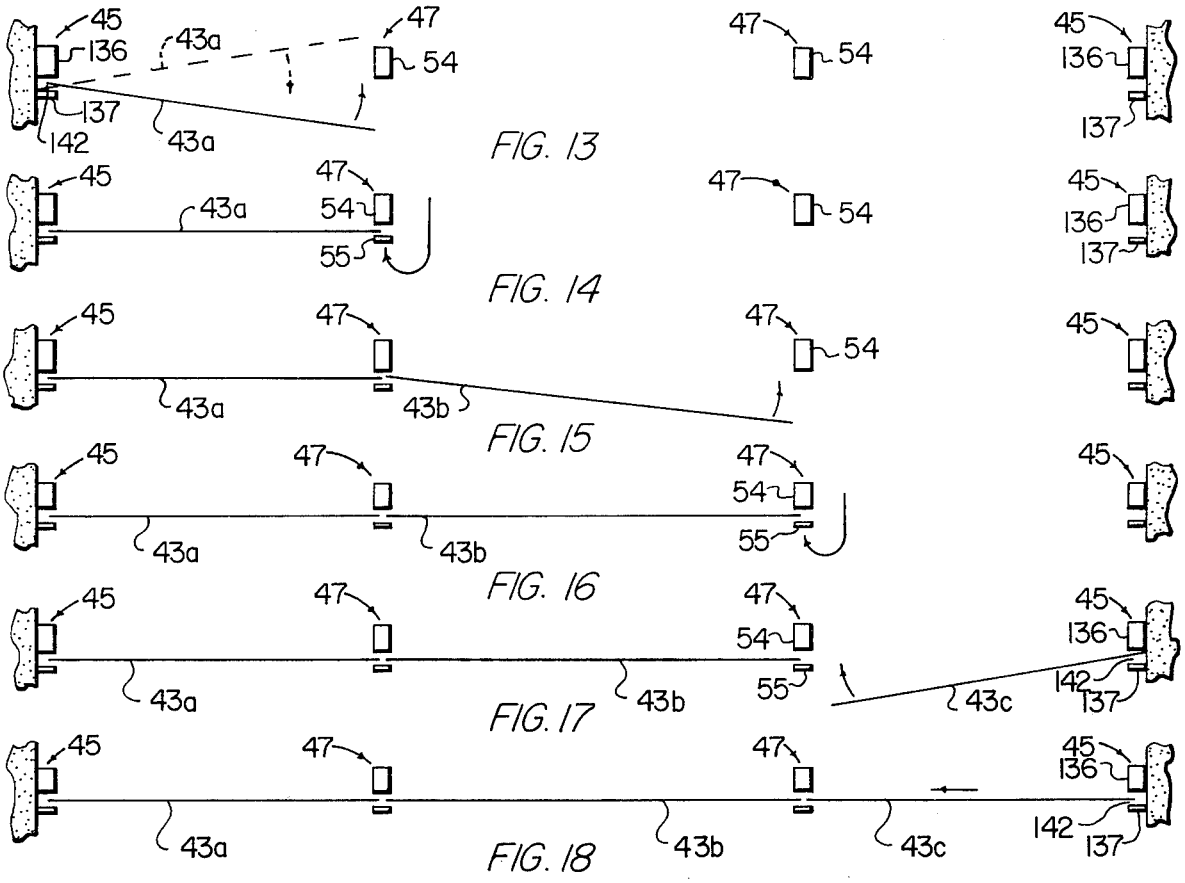
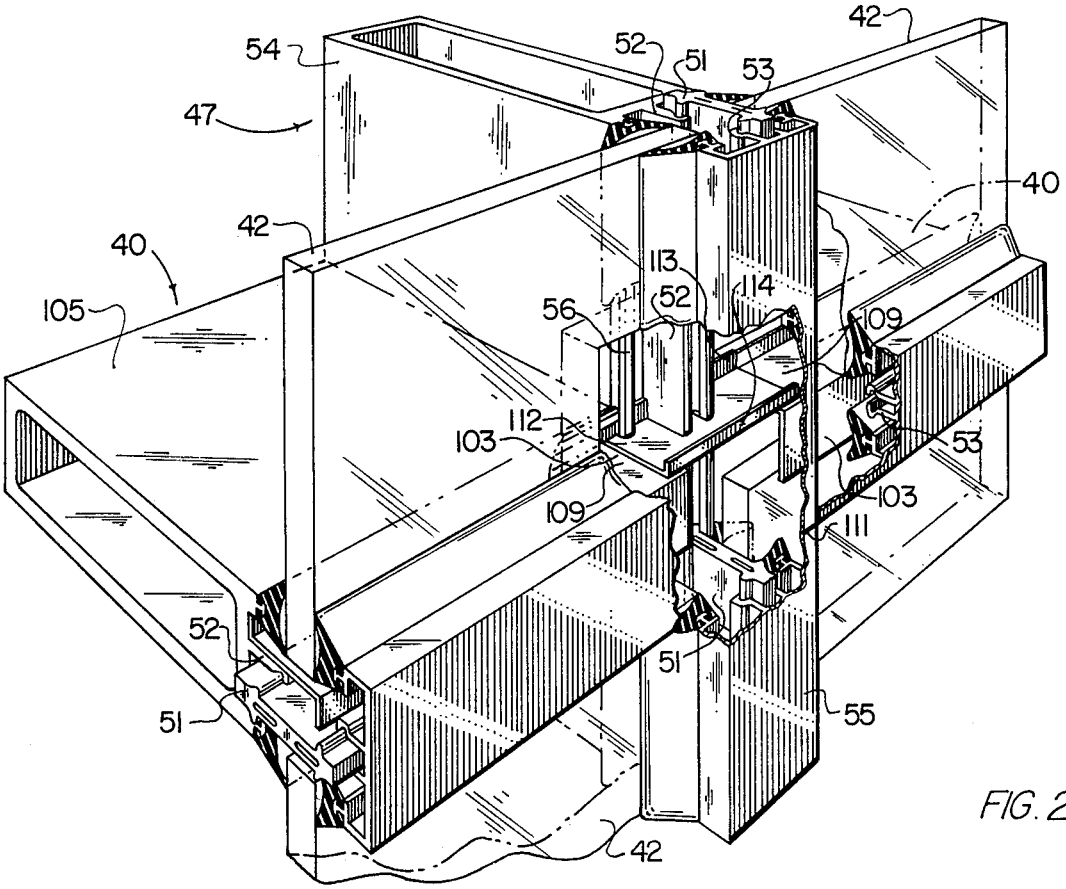
FIG. 20

WALL FRAMING SYSTEM AND COMPONENTS THEREOF

RELATIONSHIP TO OTHER APPLICATIONS

This application is a Continuation-in-part of my copending U.S. Patent Application Ser. No. 560,820, now U.S. Pat. No. 4,008,552, entitled Wall Structure and Elements Therefor, filed Mar. 21, 1975, now U.S. Pat. No. 4,008,552, which is in turn a Continuation of my prior U.S. Patent Application Ser. No. 378,321, entitled Wall Structure and Elements Therefor, filed July 11, 1973, now abandoned.

BACKGROUND OF THE INVENTION

Metal wall framing systems have been used for some time. In such systems elongated metal elements —mullions, sills, jambs, etc.—grip the edges of opaque or transparent panels of various thicknesses to form a coherent wall, either of the store front type or of the curtain wall type. Typically each mullion, etc., consists of two primary parts, one on the interior side of the panels and one on the exterior. Various forms of auxiliary parts are employed to connect the primary parts together and to effect gripping of the panels.

In a completed wall system, one problem which has presented difficulty in the past is that of water intruded into the interior of the mullions. One source of intruded water is rainwater and window washing water which leaks past panel gripping gaskets. Another source is condensation from moist air within the mullions. Intruded water which is in the portions of the mullions that are exterior of the panels can be disposed of fairly readily by means of weep holes and the like. But intruded water which is in the portions of the mullions which are interior of the panels presents a serious disposal problem. it is aggravated in multi-story curtain wall structures, where a column of water a number of feet deep can readily accumulate in a vertical mullion. The interior panel gripping gasket confining such water will eventually leak under the pressure exerted by the column of water, and the water will be discharged into the interior of the building, which is always objectionable and often causes damage.

Another problem in completed wall systems is that of repair of broken panels (reglazing). In some wall systems, not only must the mullions immediately surrounding the broken panel be disassembled, but in addition, a significant portion of the undamaged surrounding wall area must be dismantled in order to effect a replacement of the broken panel.

In a curtain wall under construction, installers encounter difficulties with some wall systems in installing mullions in areas opposite ceilings or floor decks, where the cramped space available makes operations which are otherwise readily performed difficult and clumsy to execute.

In multi-story curtain walls, it is important to provide a wall systems in which the panels may be installed from within the building. If this is not done, installation expense is increased objectionably, since external scaffolding must be provided, erected, and dismantled as part of the wall installation procedure. Nonetheless, it is also important to be able to replace broken or damaged panels from outside the building, to avoid disturbing the occupants and interior furnishings.

SUMMARY OF THE INVENTION

In accordance with the invention there is provided a wall framing system in which the horizontal mullions are equipped with internal water diverters. The diverters are shaped and positioned to conduct intruded water which is in the portion of the mullion behind (i.e., interiorly of) the panel above the mullion to the portion of the mullion which is in front of (i.e., exteriorly of) and below the top edge of the panel immediately beneath the mullion. By interrupting the lower front glazing gasket of the mullion at intervals along its length, paths are created for escape of the thus diverted water to the outside. Alternately, spaced holes may be drilled in this portion of the mullion.

The internal water diverters are employed to insure that the water intruding into the interior of a frame member does not penetrate through the wall into the building interior. As is explained below, the diverter is shaped to extend from a point behind (toward the building interior) the bottom edge of a panel located above the frame member, to a point in front of the top ege of a panel located below the frame member.

Also, in accordance with the invention, at the crossing of horizontal and vertical mullions, internal bridge pieces are provided which run cross-wise of the vertical mullion in the portion thereof interiorly of the panels, in a position to block downward flow of water in the vertical mullion. The internal bridge piece extends from the water diverter in the horizontal mullion on one side of the crossing to the water diverter in the horizontal mullion on the other side of the crossing. The bridge piece is connected to both water diverters. Thus, water falling downwardly through the vertical mullion in the portion thereof interiorly of the panels, is directed by the bridge piece at the crossing outwardly onto the water diverters in the horizontal mullions, and ultimately out of the horizontal mullions through the interruptions in the glazing gasket thereof, discussed above.

In further accordance with the invention, a wall system is provided in which, in multi-story curtain wall installations, the vertical mullions are formed in multiple sections, each having a height substantially equal to and coextensive with the height of the panels which are mounted on either side of it. Thus, when a damaged panel must be removed and replaced, only those mullion sections which are located on the immediate perimeter of the damaged panel need be disassembled and reassembled.

In order to facilitate installation of the mullions in the cramped areas adjacent ceilings and floor slabs, a horizontal mullion piece of novel construction is provided in the wall system of the invention. The horizontal mullion piece includes an open channel portion having bracket mounting means therein for readily forming joints with vertical mullions, even in cramped working areas. In addition, means are provided for closing the open channel portion of the mullion after forming of the joints when architectural or aesthetic considerations require it. The closing means are so constructed to insure that the channel portion is brought to square-up condition in the course of forming the closure.

Furthermore, in accordance with the invention, a wall system is provided which may be glazed easily from the interior of the building under construction, one floor at a time. Among the features of the invention making this possible are the single panel height vertical mullion sections discussed above, the open channel horizontal mullions which can be installed over the next lower installed panels readily, and perimeter jambs having deep glazing pockets formed therein.

OBJECTS OF THE INVENTION

From the foregoing, it can be seen that it is an object of the present invention to provide a wall framing system in which provision is made for expelling intruded water from both the vertical and horizontal members of the system.

A further object is to provide a wall structure wherein the horizontal members of the framework are provided with water diverters which direct water which may accumulate between spaced horizontal edges of vertically adjacent panels of the wall structure to the exterior of the top edge portion of the lower panel.

Another object of the invention is the provision of a wall system in which broken panels may be replaced by disassembling a minimum amount of the system in the immediate vicinity of the broken panel.

It is an object of the invention to provide a wall system having a novel horizontal mullion readily adapted for handling and installation in cramped work areas adjacent ceilings and floor slabs.

A further object of the invention is the provision of a wall system which may readily be glazed from the inside of a multi-story building under construction.

The foregoing objects and purposes, together with other objects and purposes, may be better understood by a consideration of the detailed description which follows, together with the accompanying drawings.

DESCRIPTION OF THE DRAWINGS

FIGS. 13 through 18 are very diagrammatic horizontal sectional views illustrating sequentially various steps in the installation of panels from the interior of a building under construction on an upper floor thereof;

FIG. 20 is a fragmentary isometric view, with some parts broken away for clarity, of a crossing between intermediate horizontal and vertical mullions, and showing the intruded water expulsion features of the invention.

DESCRIPTION OF THE PREFERRED EMBODIMENTS

Figure 1:
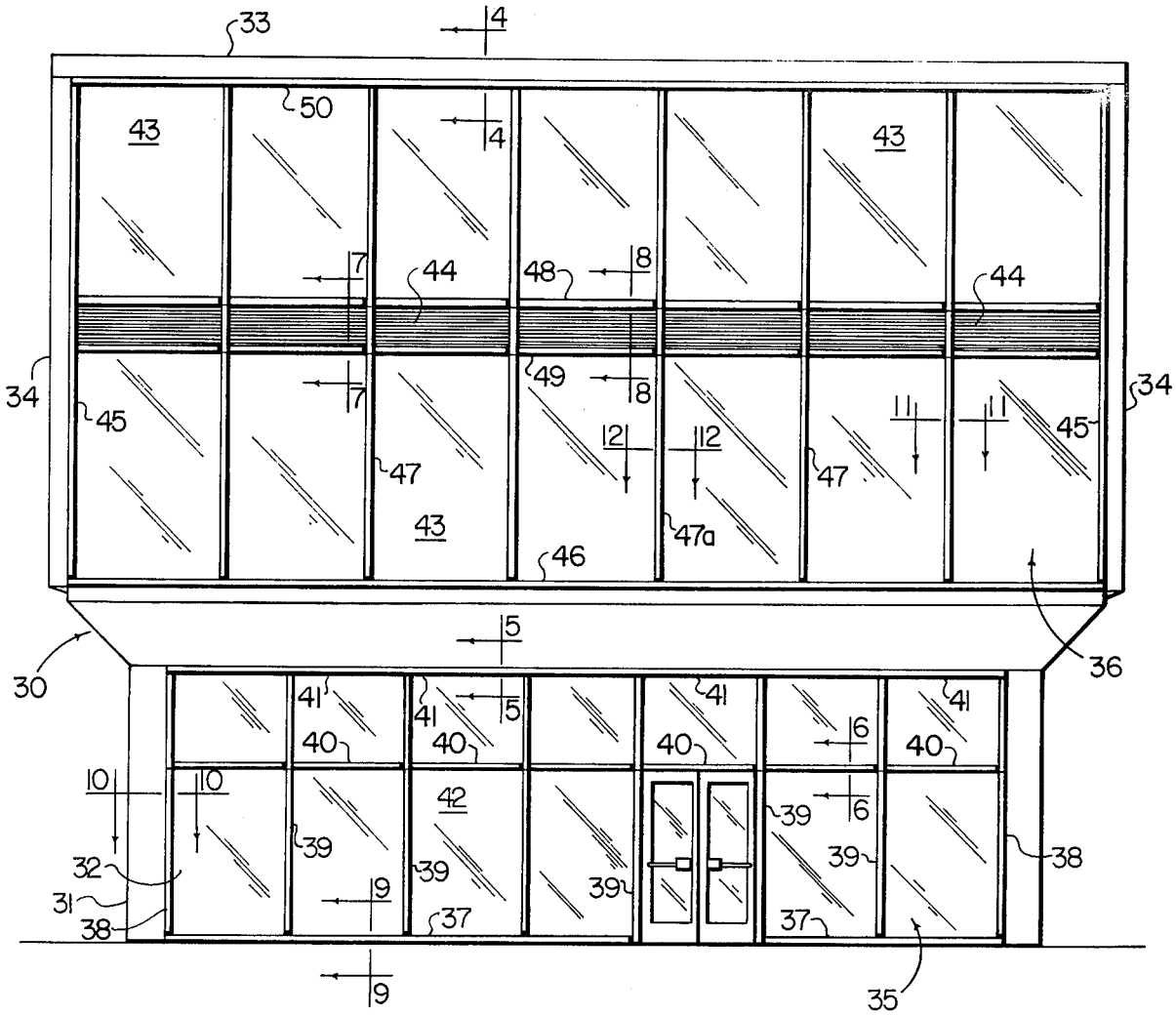
FIG. 1 is a diagrammatic elevational view of a building having the wall system of the invention installed therein, and having designators orienting the location of various of the cross sectional views which follow.

In FIG. 1, there is shown diagrammatically a building designated generally as 30, having the wall system of the invention installed therein. Building 30, as a matter of architecture, is somewhat arbitrary in design, being calculated to illustrate various features of the invention. It includes a masonry base portion 31, having a store front opening 32 therein, a roof slab 33, and masonry covered corner posts 34 which, along with internal frame members, support the roof slab above the base.

Two different modes of installation of the wall system of the invention are shown in FIG. 1. In the store front opening 32 on the ground floor of building 30 there is installed a store front type wall system designated generally as 35, designed for glazing from the exterior of the building. In the upper floor section of building 30, between base portion 31 and roof slab 33, there is installed a curtain wall type wall system designated generally as 36, designed for glazing from the interior of the building.

The store front type wall system 35 includes sills 37, jambs 38, vertical mullions 39, intermediate horizontal mullions 40, and header mullions 41, all of which grip the edges of panels 42.

The curtain wall type wall system 36 extends over two (or more) stories of building height and includes transparent panels 43 and opaque panels 44. The panels are gripped by jambs 45, sill 46, vertical mullions 47, intermediate horizontal mullions 48 and 49, and header mullion 50.

PLASTIC CONNECTOR CLIP SYSTEM

The wall system of the invention is one in which thermal isolation between the internal and external framing members making up any given mullion is obtained through the use of spaced plastic connector clips. Such a connector system is fully shown and described in my parent patent application Ser. No. 560,820, together with the various advantages flowing from such use. In the present application, the plastic connector clips are designated 51, and the gripping flanges in which they work are designated 52, 53 throughout the series of views.

Figure 11:
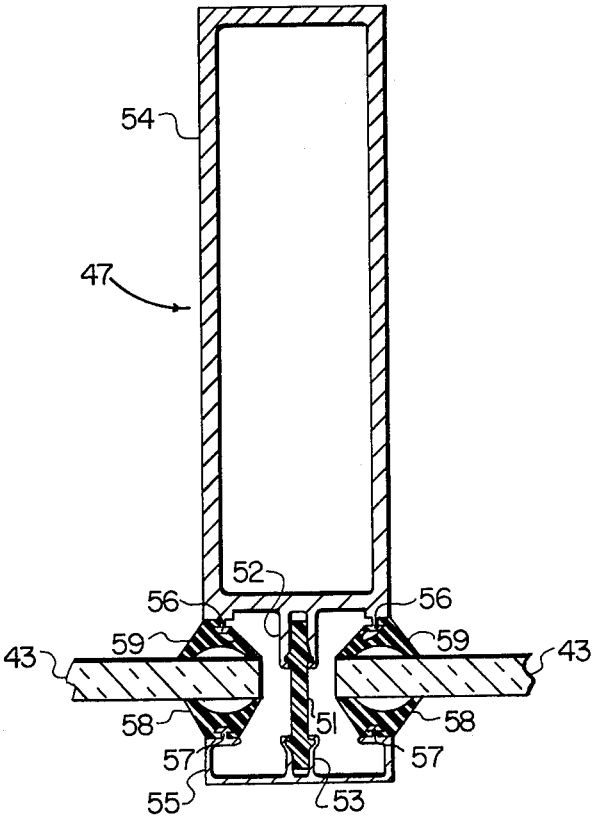
FIG. 11 is a horizontal cross sectional view of an intermediate vertical mullion, the section being taken on the line 11—11 of FIG. 1.

Attention is directed to FIG. 11, which shows the plastic connector framing element construction system in its simplest form, in the context of an intermediate vertical mullion 47. Mullion 47 includes an interior piece 54, which is generally rectangular in cross section, and an exterior piece 55, which is generally U-shaped in cross section. The interior piece 54 has flanges 52 formed midway of a narrow face thereof; the exterior piece 55 has flanges 53 formed midway of the base of the "U" thereof. The flanges 52 and 53 each comprise parallel upstanding ribs having facing detent grooves formed therein.

The interior and exterior pieces 54 and 55 are assembled with flanges 52 and 53 in facing relationship. The resilient plastic connector clips 51 are formed with detent ridges thereon which lockingly engage the detent grooves in flanges 52 and 53 when opposite ends of the clips are inserted in the flanges. The connector clips 51 are relatively short, on the oder of 1 inch, and are spaced out along the flanges at intervals on the order of 1 foot.

At the corners of the face of interior piece 54 which carries flange 52, there is formed another set of flanges, glazing gasket flanges 56. Similarly, glazing gasket flanges 57 are formed at the ends of the legs of the "U" of exterior piece 55. Two forms of glazing gaskets, differing somewhat from each other in profile, are employed in accordance with the invention. For those gasket positions where it is feasible to install the gasket on its flange before installation of the panel, gaskets 58, which are symmetrical in profile about the flange are employed. In a store front type installation, where all glazing is done from the exterior, all gaskets are of this type. For those gasket positions where it is necessary to install the gasket after the panel is in position, an assymetric gasket or wedge 59 is employed. In curtain wall type installations, where all glazing is done from the interior, at least on upper floors, all interior glazing gaskets are wedges. Both symmetrical gaskets 58 and wedges 59 grip panels 43 in a substantially weathertight manner.

A brief review of the other FIGS. will reveal that the basic plastic connector and flange mounted glazing gasket system described in connection with FIG. 11 is used in a number of different portions of the wall system. See FIGS. 5, 6, 7, 8, 9 and 12.

Figure 5:
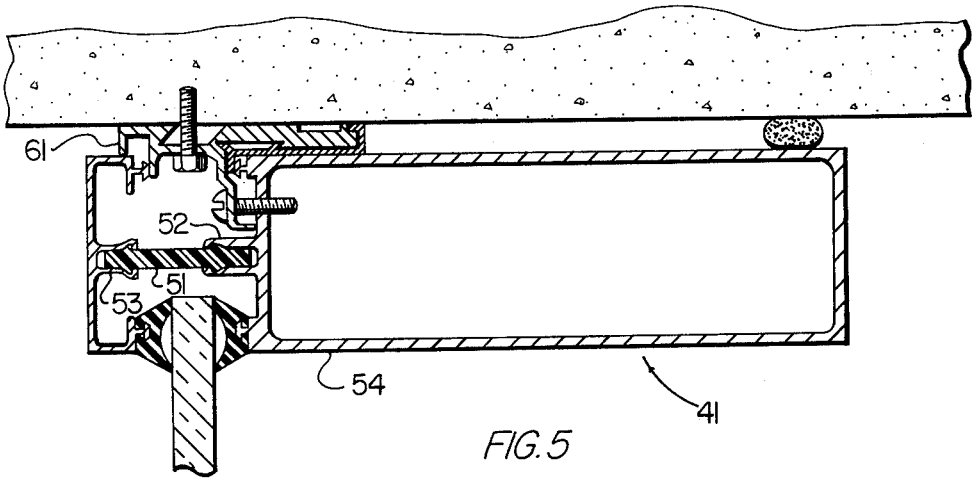
FIG. 5 is a vertical cross sectional view of a horizontal mullion installed at the top of a store front opening in a building, the section being taken on the line 5—5 of FIG. 1.
Figure 9:
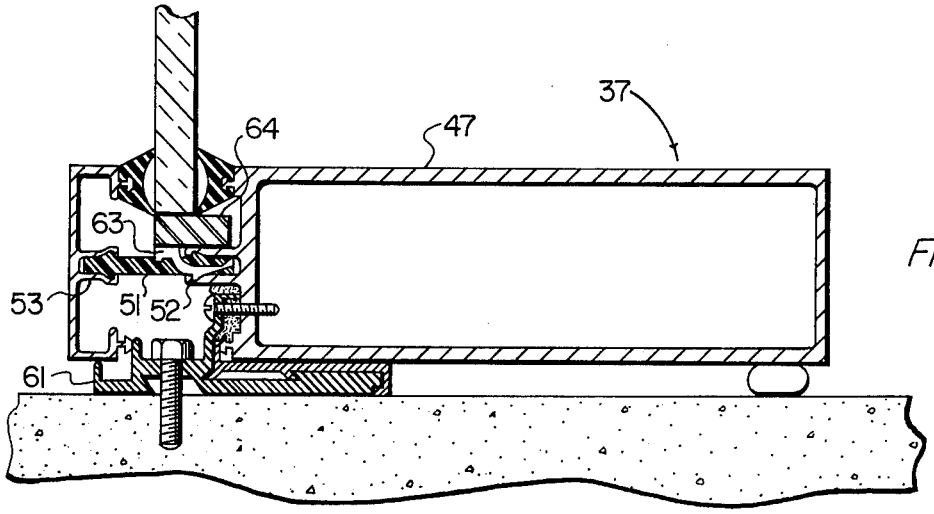
FIG. 9 is a vertical cross sectional view of a sill member in a store front type installation, the section being taken on the line 9—9 of FIG. 1.

In some of these, e.g., the header mullion 41 of FIG. 5, and the sill 37 of FIG. 9, there is a panel at only one side of the mullion, and masonry at the other side. On the masonry side of the mullion, the space normally occupied by a panel and its gaskets is filled by a masonry attachment filler 61, which is fixed to the interior piece 54 of header mullion 41 (FIG. 5) or of sill 37 (FIG. 9).

Figure 7:
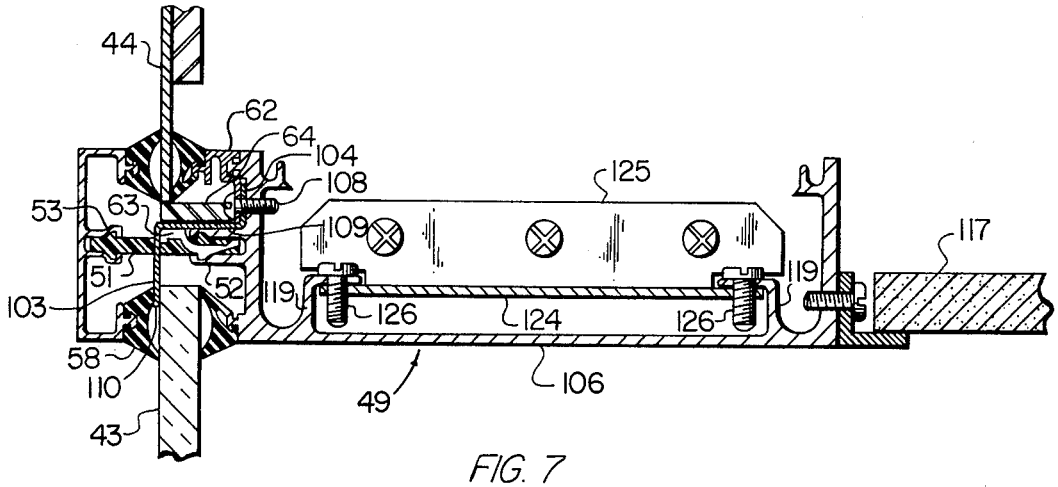
FIG. 7 is a vertical cross sectional view of an intermediate horizontal mullion in a curtain wall type installation, the mullion being positioned at a ceiling line, and the section being taken on the line 7—7 of FIG. 1.
Figure 8:
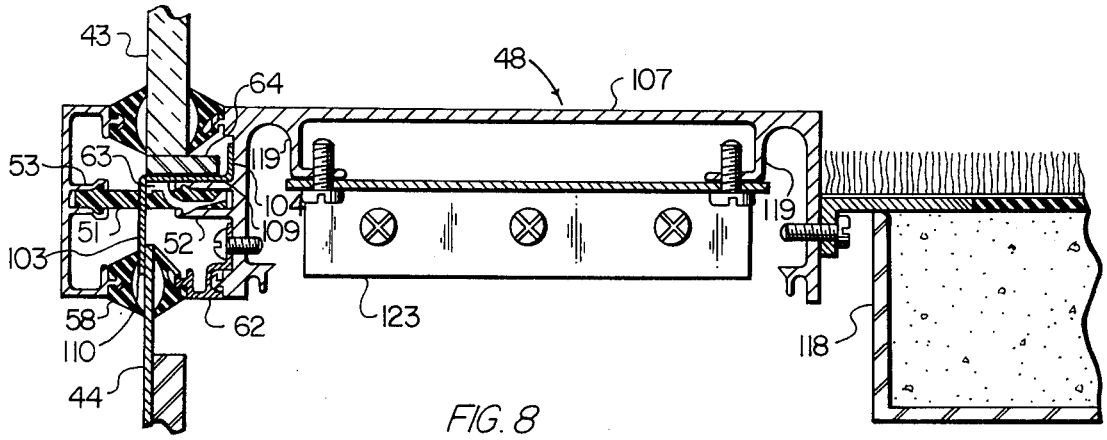
FIG. 8 is a vertical cross sectional view of an intermediate horizontal mullion in a curtain wall type installation, the mullion being positioned adjacent an upper story floor slab, and the section being taken on the line 8—8 of FIG. 1.

In the case of other mullions, e.g., the intermediate horizontal mullions of FIGS. 7 and 8, the mullion grips a relatively thick panel 43 on one side, and a relatively thin panel 44 on the other. In such instances, on the side of the mullion toward the thinner of the panels, the discrepancy in thickness is made up by an extension filler 62, which is attached to the interior piece face.

It should also be noted that the horizontal mullions and sills of the system which have panels mounted above them, e.g., those shown in FIGS. 6, 7, 8 and 9, make use of glazing "chairs" 63, mounted on flanges 42, to provide support to the superjacent panel through glazing block 64. Glazing chairs 63 are installed in flanges 52 at points therealong between the locations of the connector clips 51.

Figure 12:
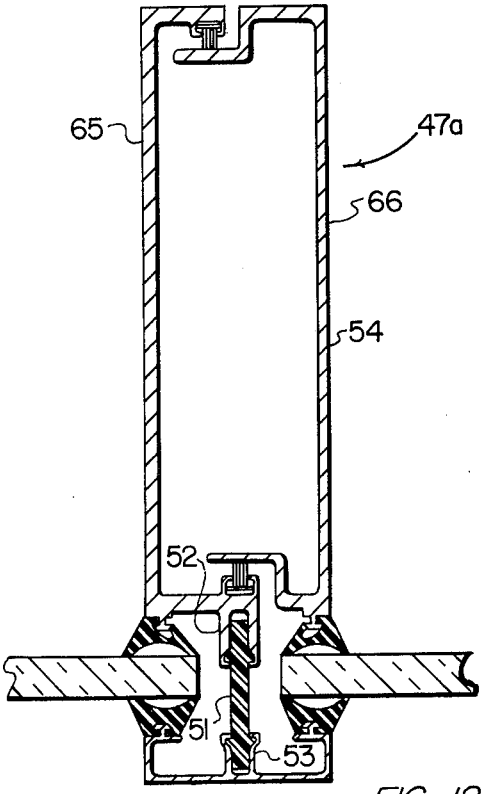
FIG. 12 is a horizontal cross sectional view of an intermediate vertical expansion mullion, the section being taken on the line 12—12 of FIG. 1.

Another structural variation which should be noted can be understood from a comparison of FIGS. 11 and 12. FIG. 11, discussed above, shows a standard intermediate vertical mullion 47 of the invention. The expansion mullion **47*a* of FIG. 12 differs from the standard mullion in that the interior piece 54 is split into two interengaging pieces 65 and 66**, which may slide horizontally with respect to each other to accomodate the expansion of aluminum in long buildings upon increases in temperature.

WATER DIVERSION SYSTEM

Figure 2:
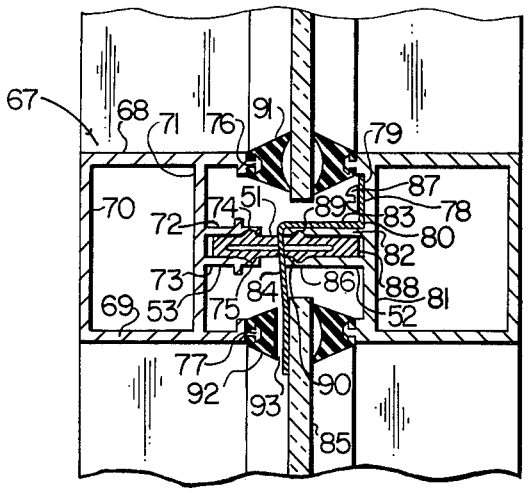
FIGS. 2 and 3 are cross sectional elevational views of horizontal mullions contructed in accordance with the invention, FIG. 2 being a mullion adapted for outside glazing and FIG. 3 being a mullion adapted for inside glazing, and the wall system of FIGS. 2 and 3 differing in some respects from that shown in FIG. 1 and FIGS. 4–20.
Figure 3:
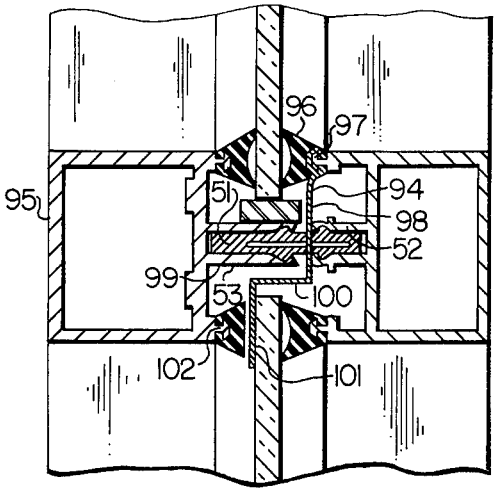
Figure 6:
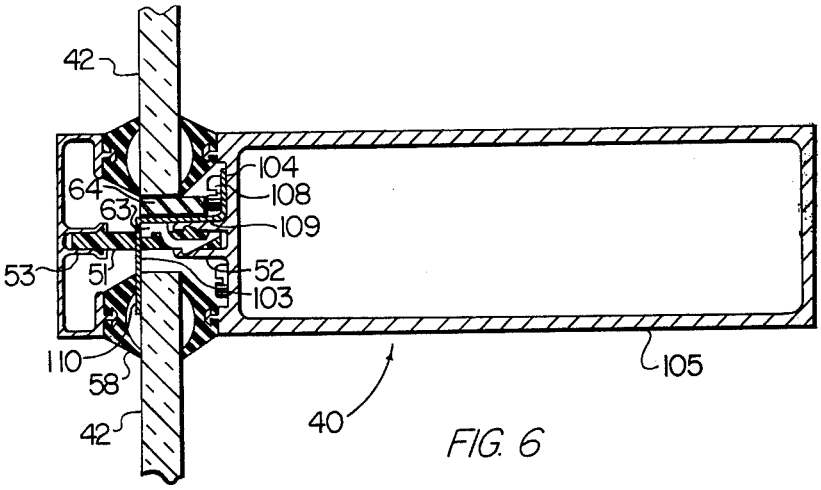
FIG. 6 is a vertical cross sectional view of an intermediate horizontal mullion in a store front type installation, the section being taken on the line 6—6 of FIG. 1.

The internal water diverter features of the invention can best be understood from a consideration of FIGS. 6, 7 and 8, which show intermediate horizontal mullions employed in the wall system of FIG. 1; from FIG. 20, which shows in isometric broken away from the diverter system construction at a mullion crossing; and from FIGS. 2 and 3, repeated from parent applications Ser. Nos. 378,321 and 520,820, which also show water diverters in intermediate horizontal mullions.

In said parent applications, the mullion of FIG. 2 is described as follows: As can be seen in FIG. 2, the horizontal face members 67 are securable to the horizontals and each has horizontal top and bottom walls 68 and 69, and outer and inner side walls 70 and 71. The inner side wall 71 has a pair of clip lock flanges 72 and 73 provided at their ends with lock recesses 74 and 75, respectively, and a pair of gasket lock flanges 76 and 77 disposed inwardly of the inner wall 71 and spaced from the lock flanges 72 and 73, respectively.

A water diverter 78, which is shown best in FIG. 2, is connected to each of the horizontals to divert water to the exterior of the wall structure. Each water diverter has a top vertical portion 79 which is adapted to abut the surfaces 80 of the vertical wall 81 of the horizontal above its top lock flange 82, a horizontal portion 83 which extends over the top surface of the lock flange 82 and a bottom vertical portion 84 which is adapted to overlap the top edge portion of the panel 85 located below the lower clip lock flange 86. The diverter may be rigidly secured to the inner wall 81 by longitudinal spaced screws 87 if desired, but such attachment may be omitted.

Water diverters 78 are installed on the horizontals, by driving the connectors 51 through appropriate spaced aperatures in their vertical portions 84 and into lock recesses of the horizontals with their lock flanges 89 and 90 moving into the lock recesses of the flanges. A sealant is then employed to seal between the connector clips and the water diverter.

A consideration of FIG. 2 will reveal that any water which may seep downwardly between the panels and each upper horizontal gaskets 91, or which may condense between the face members and frame members because of atmospheric pressure and temperature changes is directed outwardly by the water diverters and over the upper edge of the next lower panel. The lower outside gaskets, such as the gasket 92 of a face member 67 are provided with spaced passages, as at 93, to permit such water to flow to the exterior.

In said parent applications, the mullion of FIG. 3 is described as follows: The water diverters 94 are prepared for installation on the horizontals 95 immediately below the top perimeter frame member by having mounted thereon connector clips and a gasket 96 on its top channel portion 97. Each diverter has a vertical portion 98 which extends from the channel portion 97 to below the bottom lock flange 99 of the horizontals, a horizontal portion 100, and a bottom vertical portion 101 which extends below the lock flange 102 of the horizontal. The gasket on flange 102 is apertured at intervals to permit escape of water.

It will also be seen that the water diverters, such as the diverters 78 and 94, each have a vertical portion which extends upwardly of the lower portion of one panel, a horizontal portion which extends outwardly between the bottom and top edges of the two vertically aligned panels, and a vertical portion which extends outwardly of and below the top edge of the lower panel, and that connector clips extend through one of the vertical portions of the diverter and below the bottom and top edges of the panels to connect face members to the horizontal frame members of the framework.

Turning now to the water diverter system as applied to the horizontal mullions shown in FIGS. 6, 7 and 8, it can be seen that a water diverter 103 is mounted in each of these mullions. The water diverters 103 are generally Z-shaped in cross section and may be formed of polyvinyl chloride plastic or any other convenient material. Water diverter 103 is mounted in a mullion with its upper leg 104 abutting the narrow flange bearing face of the interior pieces 105, 106, 107 of mullions 40(FIG. 6), 49(FIG. 7), and 48(FIG. 8) respectively. In the cases of FIGS. 6 and 7, upper leg 104 is secured to the face of the interior piece by screws 108 spaced at intervals along its length, but in the case of FIG. 8, this optional step is omitted. If desired, upper leg 104 can be secured to the face of the interior piece by other means, such as rivets or adhesives.

The middle leg 109 of diverter 103 extends horizontally across the top of gripping flange 52 from the face of the interior piece to a point beyond the end of flange 52. It thus extends from a point behind the panel which is above the mullion to a point in front of the panel which is beneath the mullion. The middle leg 109 passes over glazing chair 63 and under glazing block 64.

The lower leg 110 of water diverter 103 extends downwardly to a point in front of, and in abutment with, the exterior face of the panel located in front of the mullion. Its downward extension is such that it extends below the top edge of the panel and is wedged between the panel and the exterior glazing gasket 58. The connector clips 51 spaced along the mullion at intervals pass through apertures formed in lower leg 110. Sealant may be applied around the apertures to insure watertightness.

Attention is now directed to FIG. 20 which illustrates the water diverter features of the invention in the context of a crossing of the mullions of FIGS. 6 and 11. The horizontal mullions 40 abut the vertical mullion 47 endwise. While the vertical mullion face 55 is divided into sections, as at parting line 111, for reasons discussed below, the sections are spliced together end-to-end by internal splices (not shown) so that the vertical mullion appears to run through the crossing and the horizontal mullions do not.

As can be seen from FIG. 20, the water diverters 103 in the horizontal mullions 40 terminate at the crossing in alignment with the ends of the mullions 40, and their ends are thus separated from each other by a distance substantially equal to the thickness of the vertical mullion 47. In accordance with the invention, a water diverter bridge piece 112 is mounted in vertical mullion 47 at the crossing which spans the gap between the ends of the water diverters 103.

Bridge 112 has upturned margins 113 and 114, and is notched to fit around flanges 52 and 56 of the vertical interior piece 54. (For clarity, the right hand glazing flange 56 has been omitted from FIG. 20 because of the crowded nature of that portion of the drawing.) The length of bridge 112 is such that it overlaps somewhat, and is supported by, the horizontal legs 109 of the water diverters 103. The width of the bridge 112 is substantially the same as the width of the middle leg 109 of water diverter 103. Thus bridge 112 extends across all of the interior of vertical mullion 47 which is in front of the face of interior piece 54 and interiorly of panels 42. Any water falling downwardly in this portion of mullion 47 will be intercepted by bridge 112 and diverted out onto the water diverters 103 of the horizontal mullions 40, and ultimately out of those mullions through the beforementioned gaps in the lower glazing gaskets. Furthermore, any water moving horizontally along the surface of middle leg 109 of the water diverter 103 will not fall down into the vertical mullion, but will move across the bridge 112 and onto the next water diverter.

OPEN CHANNEL MULLIONS

Figure 4:
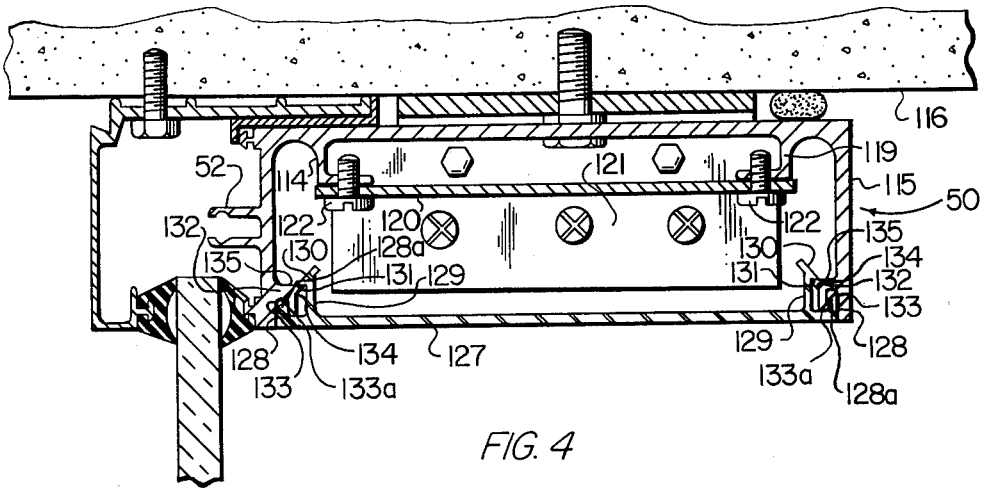
FIG. 4 is a vertical cross sectional view of a horizontal mullion installed beneath a roof slab, the section being taken on the line 4—4 of FIG. 1.

The FIGS. best illustrating this feature of the invention are FIGS. 4, 7 and 8. In FIGS. 4, the interior piece of the header mullion 50 is designated 115, while in FIGS. 7 and 8 it is designated 106 and 107 respectively. The mullion of FIG. 4 is installed beneath a roof slab 116; the mullion of FIG. 7 is installed at a room ceiling 117; and the mullion of FIG. 8 is installed at an upper story floor slab 118. In accordance with the invention, the interior pieces of the mullions employed at these locations are of open channel configuration, as opposed to the boxlike closed configuration employed at other points in the wall system. Compare the mullions of FIGS. 6 and 8 for example. Open channel mullions are employed at these locations because work space at them is typically cramped in a building under construction, making it clumsy to form joints between vertical and horizontal mullions when the more conventional boxlike closed mullions are employed.

The open channel mullions of the invention are provided with internal L-shaped flanges 119 which serve as bracket connecting means. Flanges 119 run parallel to each other along the length of the mullion and rise from the base of the channel. The foot of the "L" of the flange is thus spaced from and parallel to the base of the channel. The surfaces of the feet of the "L's" act as abutment surfaces which engage the surfaces of joint forming brackets, with fastening screws being driven through the region of abutment.

It should be noted that both the upper and lower surfaces of the feet of the "L's" of flanges 119 are available for use as abutment surfaces. Thus, in FIG. 4, the flange 120 of joint forming bracket 121 is abutted against the bottom surfaces of the feet of the "L's" of flanges 119, and they are joined by screws 122. In FIG. 8, the joint forming bracket 123 is attached to flanges 119 in the same manner. However, in the situation shown in FIG. 7, the flange 124 of joint forming bracket 125 abuts the top surfaces of the feet of the "L's" of flanges 119, and they are joined by screws 126.

One advantage of the foregoing structural arrangement is that the base of the channel section is not penetrated by the fastening means used to form the joints. This is of advantage in the situation illustrated in FIG.

7, where the channel base is visible as an extension of ceiling 117, and in the situation illustrated in FIG. 8, where the channel base is also visible, and form an aesthetic viewpoint is the sill of a floor-to-ceiling window.

A comparison of FIGS. 7 and 8 will reveal that the open channel interior pieces 106 and 107 have the same extrusion profile, but that piece 106 is installed with the channel base facing downwardly, while piece 107 is installed with the channel base facing upwardly. Thus a single extrusion can serve in either position. The open channel is positioned in each case to face in a direction which is aesthetically unobjectionable, and its openness permits improved and relatively easy access to tools and fastenings in the cramped working areas where such pieces must be mounted.

In the situation illustrated in FIG. 4, the open channel interior piece is installed with the channel opening facing downwardly, which is aesthetically objectionable. Therefore, in accordance with the invention, channel cover plate 127 is provided. As is known, generally U-shaped extrusions tend to "toe in" or "toe out" slightly, and to do so non-uniformly from piece to piece, thus creating a problem in fitting cover plate 127 onto channel piece 115.

This problem is overcome in accordance with the invention by providing cover plate 127 with short upturned flanges 128 at its margins, having slightly diverging camming surface 128*a* and with a pair of upstanding camming flanges 129 spaced somewhat inwardly of the marginal flanges 128. Camming flanges 129 are taller than marginal flanges 128 and terminate in camming surfaces 130. The camming surfaces on the two camming flanges 129 converge toward each other. At the outboard edges of the camming surfaces 130 are formed detent locking lips 131.

The parts just described on cover plate 127 cooperate with a pair of projections 132 formed near the ends of the sidewalls of open channel 115. Projections 132 face inwardly and are provided with grooves 133 which mate with marginal flanges 128, which grooves have camming surfaces 133*a*, and with camming surfaces 134 which cooperate with camming surfaces 131 of the cover plate. The backs 135 of projections 132 act as detent locking surfaces and cooperate with the detent locking lips 131 of the cover plate.

The foregoing structural arrangement produces an open channel mullion piece with a snap-lock cover plate. When the cover plate 127 is first brought into contact with the open channel piece 115, the camming surfaces 130 and 134 react on each other to pry the legs of the channel, which are most likely toed-in a slight but variable and indeterminate amount, apart toward true perpendicular relationship with the base of the channel. As the camming surfaces slide past each other, this process is completed, and flanges 128 of the cover plate enter grooves 133 of the channel piece. Finally camming surfaces 130 and 134 move out of contact, and the energy of distortion stored in both the cover plate and the channel cause the detent lip 131 to snap into locking relationship with detent locking surface 135. The two parts are thus united to form a closed box-like cross section. If the channel is toed-out instead of being toed-in, camming surfaces 128*a* and 133*a* react on each other to pull the channel legs together to true perpendicular relationship with the base of the channel.

INTERIOR GLAZING SYSTEM

Figure 10:
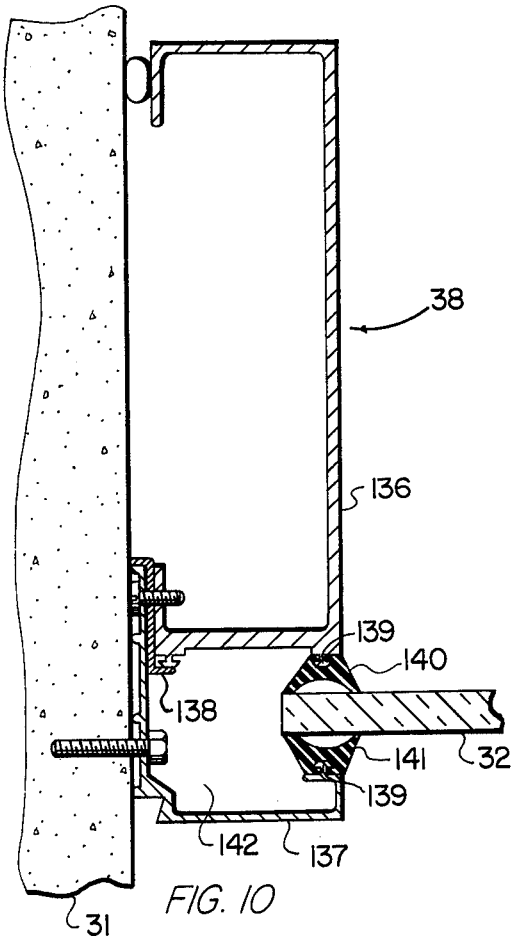
FIG. 10 is a horizontal cross sectional view of a vertical jamb member, the section being taken on the line 10—10 of FIG. 1.

The features of the present invention which facilitate interior glazing may best be understood from a consideration of FIGS. 10, 11 (discussed above), 13–18, 19A, and 19B.

FIG. 10 shows vertical jamb 38, which comprises interior piece 136, exterior face piece 137, and thermal isolator 138, by which the parts are secured to masonry wall 31. Interior piece 136 and face piece 137 are provided with glazing gasket flanges 139, and carry glazing gaskets 140 and 141 which grip panel 32. If panel 32 is installed from the exterior, gasket 140 is symmetrical in profile, and gasket 141 is a wedge. If panel 32 is installed from the interior, gasket 140 is a wedge having an assymetrical profile, and gasket 141 is symmetrical.

A consideration of FIG. 10 will reveal that a relatively large space 142, here termed a deep glazing pocket, is established between interior piece 136, and exterior face 137. Deep glazing pocket 142 is important for interior glazing operations, as will be discussed below.

Vertical jamb 45 (FIG. 1), in the curtain wall section of the building 30, has the same structure as vertical jamb 38, in the store front section of building 30, and the discussion of jamb 38 above in connection with FIG. 10 is fully applicable to jamb 45.

Figure 19A:
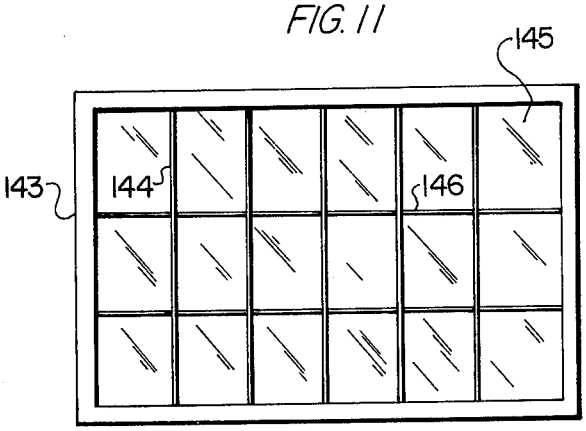
FIG. 19A PRIOR ART
FIG. 19A is a diagrammatic elevational view of a typical prior art wall system.

FIG. 19A shows very diagrammatically, a building 143 having a typical prior art curtain wall installed therein. The vertical mullions 144 of the curtain wall extend over the height of several panels 145. The horizontal mullions 146 extend over only a single panel width. One consequence of this form of construction is that when one of the panels 145 must be removed and replaced, it is necessary to disassemble and reassemble mullions 144 adjacent the damaged panel for the full length of the mullions, including those sections adjacent undamaged panels.

Figure 19B:
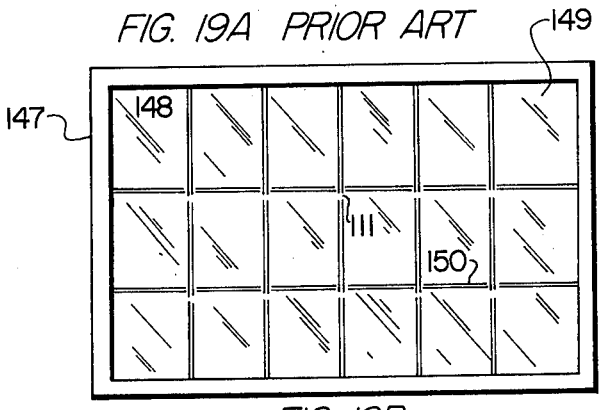
FIG. 19B is a diagrammatic elevational view of a wall system constructed in accordance with the invention.

FIG. 19B shows, very diagrammatically, a building 147 having a curtain wall of the invention installed therein. The vertical mullions 148 have faces which are divided into sections at parting lines 111 (shown also in FIG. 20), and are connected together by internal splices (not shown) to give the appearance of being continuous mullions extending over the height of several panels 149. In actuality, the vertical mullion sections are substantially equal to the height of a panel 149, and are aligned to be substantially coextensive therewith. The horizontal mullions 150 extend over only a single panel width.

One advantage of the form of construction of the invention is that only those mullions and mullion sections which immediately surround a damaged panel need be disassembled in the course of replacing it. Another advantage is that the wall systme of the invention can be installed one floor at a time, and glazed from the interior one floor at a time, thus saving on the cost of installation. In addition thermal stresses are accommodated and dissipated locally on the wall instead of being transmitted to other parts of the wall.

Attention is now directed to FIGS. 13–18, which are very diagrammatic sequential illustrations of the procedure, in accordance with the invention, for glazing a single floor from the interior of a building under construction. As FIGS. 13–18 are drawn, the interior of the building is in all cases toward the top of the FIG. For simplicity, the horizontal mullions are omitted from FIGS. 13–18. In fact, however, the lower horizontal mullions are in place before the panels are installed, and the upper horizontal mullions are installed after the panels are put in place.

Starting with FIG. 13, panel 43*a* is initially positioned as is indicated by the dashed line, with its left edge far into deep glazing pocket 142 of jamb 45. This enables the right edge of panel 43*a* to be swung outwardly (dashed arrow) past interior piece 54 of mullion 47, to the position indicated by the full line in FIG. 13. At this point the panel is slid to the right slightly, so that its edge is not as far into glazing pocket 142, and the panel is swung inwardly (full arrow) so that its right edge abuts interior piece 54 of mullion 47. All of the foregoing operations are performed by workers standing in the interior of the building, using standard suction type panel grippers.

Next, as is shown in FIG. 14, the installers move to the right to the next panel position, pass a mullion face piece outwardly through it, and, working from within the building, connect it to interior piece 54 to complete the lefthandmost intermediate mullion 47. These actions are indicated by the J-shaped arrow in FIG. 14. Panel 43*a* is thus in its designed position and held there on the bottom and sides by the mullions. The manipulations described thus far were carried out with the external glazng gaskets in place, but the internal glazing wedges are installed after the panel is in position.

The upper horizontal mullion for panel 43*a* may now be installed, or its installation may be deferred until all panels on the floor are in position and ready for upper horizontal mullion installation.

The workers next move panel 43*b* through its opening, holding it at a tilted orientation so that the right hand edge passes through the opening first. The panel is then moved slightly leftwardly to insert its left edge into the glazing slot between parts 54 and 55 of lefthandmost intermediate mullion 47. Panel 43*b* is now in the position shown in FIG. 15, and, as indicated by the arrow in that FIG. its right edge is swung inwardly to abut interior piece 54 of the righthandmost intermediate mullion 47.

The fact that face piece 55 is absent from righthandmost intermediate mullion 47 when the manipulations of panel 43*b* are carried out as described in connection with FIG. 15 means that in a sense the workers were taking advantage of an "infinitely deep" right hand glazing pocket in bringing panel 43*b* into position.

Next, as is indicated in FIG. 16, face piece 55 is connected to interior piece 54 to complete righthandmost intermediate mullion 47, this operation being performed in the manner previously described in connection with FIG. 14, as is indicated by the J-shaped arrow in FIG. 16.

If the building under construction has walls more than three panels wide, as is shown in FIGS. 13–18, the procedure of FIGS. 14–16 is repeated as many times as necessary as the installers work their way across the building from one panel opening to the next. Eventually they will reach the righthandmost panel opening, where the procedures of FIGS. 17 and 18 are employed.

At the righthandmost panel opening, the panel 43C is moved through the opening in tilted oriention, with its lefthand edge leading. Then it is slid to the right, to the position shown in FIG. 17, with its righthand edge far into deep glazing pocket 142 of righthandmost jamb 45. As indicated by the arrow in FIG. 17, panel 43*c* is then swung inwardly to bring its left edge into alignment with the glazing slot in righthandmost intermediate mullion 47.

Finally, as is shown in FIG. 18, panel 43*c* is slid slightly to the left to move its left edge into the glazing slot of righthandmost intermediate mullion 47, and its right edge to a position less deep glazing pocket 142.

From the foregoing, it can be seen that in accordance with the invention a wall system is provided which is superior in its handling of intruded water, in its installation characteristics in crowded spaces, in its method of installation, and in its ease of repair.

What is claimed is:

1. In a wall structure having hollow horizontal and vertical panel gripping mullions and having a mullion crossing at which said horizontal and vertical mullions cross, said crossing being of the type in which the vertical mullions pass through the crossing and the horizontal mullions abut the vertical mullions at the crossing, said mullions comprising interior and exterior pieces attached together internally at spaced intervals, the improvements comprising:

water diverters mounted internally in each of the horizontal mullions, said diverters each extending from a point in the mullion interiorly of and above the lower edge of an upper panel gripped by the horizontal mullion to a point in the mullion exteriorly of and below the upper edge of a lower panel gripped by the horizontal mullion;

means in said horizontal mullions adjacent the exterior-most portions of said water diverters for permitting egress of water from the interior of said mullions;

and a water diverter bridge piece extending horizontally through a portion of said vertical mullions at the crossing between points of attachment of interior and exterior pieces thereof from the water diverter in one horizontal mullion of said crossing to the water diverter in the other horizontal mullion of said crossing.

2. A wall structure in accordance with claim 1 in which said water diverters have a horizontally oriented planar portion, and in which said water diverter bridge has a width substantially coextensive with the width of said horizontal planar portion.

3. A wall structure in accordance with claim 2 in which said water diverter bridge piece has upturned margins.

4. In a wall structure having horizontal and vertical panel gripping mullions and having a mullion crossing at which said horizontal and vertical mullions cross, said mullions comprising interior and exterior pieces attached together internally, the improvements comprising:

water diverters mounted internally in each of the horizontal mullions, said diverters each extending from a point in the mullion interiorly of and above the lower edge of an upper panel gripped by the horizontal mullion to a point in the mullion exteriorly of and below the upper edge of a lower panel gripped by the horizontal mullion;

means in said horizontal mullions adjacent the exterior-most portions of said water diverters for permitting egress of water from the interior of said mullions;

and a water diverter bridge piece extending horizontally through a portion of said vertical mullions at the crossing from the water diverter in one horizontal mullion of said crossing to the water diverter in the other horizontal mullion of said crossing;

in which the interior and exterior pieces of said vertical mullion are attached together by attachment means including flanges on said interior piece, and in which said water diverter bridge piece is notched to fit around said flanges.

5. A wall structure assembly including: an elongate frame member having longitudinal outwardly extending first lock means providing a first longitudinal lock recess; an elongate face member having longitudinal outwardly extending second lock means alignable with said first lock means, said second lock means having a second longitudinal lock recess; a connector clip having opposite end portions telescopical in said lock recesses, said connector clip and said lock means having cooperable lock means for preventing withdrawal of said end portions from said recesses; wherein each of said members has at least one longitudinal gasket lock means extending outwardly parallel to and spaced from the lock means thereof, said gasket lock means of one of said frame members extending outwardly from said one of said frame member a shorter distance than its lock means, said first lock means providing a longitudinal stop surface for a panel whose peripheral edge portion is receivable between said members; resilient gasket means mounted on said gasket lock means for engaging opposite sides of a panel whose peripheral portions are receivable between said member, said gasket means being compressed between said members and said panel to seal therebetween; and an elongate water diverter means extending downwardly from one of said members and below the bottom end of a panel whose peripheral bottom portion is receivable between said members above said lock means for diverting water to the exterior of the wall structure outwardly of an immediately lower panel.

6. A wall structure assembly including: a pair of elongate elements, each of said elements comprising a body having at least one planar longitudinal surface, a pair of parallel longitudinal lock flanges extending perpendicularly outwardly from said surface, said lock flanges having facing longitudinal lock grooves adjacent their outer edges, said lock grooves being defined at outer edges thereof, by lock shoulders which extend perpendicularly relative to said lock flanges and facing said surface, a pair of parallel longitudinal gasket lock flanges extending longitudinally from said surface and spaced outwardly on opposite sides of said lock flanges, each of said gasket lock flanges having means engageable with a gasket for securing a gasket to said element, said pairs of lock flanges of said pairs of elongate elements being connectible by connector means whose opposite end portions are telescopical between the flanges of said pairs of lock flanges, and having lock means receivable in said lock grooves and engageable with said perpendicular shoulders for locking said pair of members to each other; and a water diverter having a top vertical portion disposed adjacent said surface of one of said elements, a horizontal portion which extends outwardly of the parallel longitudinal lock flanges of said one of said elements, and a bottom vertical portion which extends downwardly from the outer edge of said horizontal portion.

7. The wall structure assembly of claim 6 and connector clips extending through longitudinally spaced apertures in one of said vertical portions of said water diverter and having opposite end portions receivable between said pairs of lock flanges after locking said elements to one another with said one vertical portion extending therebetween.

8. A wall structure assembly including: a pair of elongate elements having parallel spaced facing interior surfaces; longitudinal lock means extending from said surfaces toward one another; an internal water diverter having a top vertical portion adjacent said surface of one of said elements above its lock means, a horizontal portion extending outwardly from the bottom edge of said top horizontal portion and a bottom vertical portion extending from the outer edge of said horizontal portion, the bottom vertical portion extending between said lock means of said elements and having longitudinally spaced apertures therein in which are positioned connector means for engaging said lock means for locking said elements to one another in spaced relationship.

9. The assembly of claim 8, wherein said connector means comprise connector clips which have external lock flanges spaced from opposite sides of the bottom vertical portion of the diverter, said connector clips being sealed to the bottom vertical portion of the diverter.

10. A wall construction element especially suited for use as a horizontal frame member for securing and mounting two vertically oriented panels, one located above and one located below it, said element comprising:

internal and external elongate horizontal-forming members adapted to sandwich between them the bottom edge of an upper panel and the top edge of a lower panel;

internally positioned connecting means for securing said internal and external members together, and for applying gripping forces to said panel edges, said connecting means being spaced at intervals along said members and extending between the sandwiched edges of said panels;

and an elongate water diverter positioned between said internal and external horizontal-forming members, and extending, in the vertical direction, from a position externally of the top edge of the lower panel to a position internally of the bottom edge of the upper panel, said diverter being apertured to accommodate said connecting means.

11. A wall construction element in accordance with claim 10 and further comprising apertures in the bottom of said external elongate member exteriorly of the top edge of said lower panel.

12. An intermediate horizontal mullion for use in a wall framing system comprising:

a generally U-shaped channel member having panel engaging means on the exterior of one leg of the "U";

the legs of said channel member being substantially equal in length to the overall thickness of said mullion;

and said channel member further having joint forming flange means extending from the base of "U" into the interior thereof;

the extension of said flange means being less than the height of the legs of the "U";

a cover for the U-shaped channel and snap-lock connecting means on said cover and on the interior of the legs of the "U" for uniting the channel and cover by snap-locking action;

in which said snap lock connecting means comprise:

a pair of upturned flanges on said cover at the margins thereof;

a pair of upstanding camming flanges spaced inwardly of said marginal flanges, said camming flanges being taller than said marginal flanges;

said camming flanges terminating in converging camming surfaces and further being provided with detent locking lips at the outboard edges of said camming surfaces;

a pair of inwardly facing projections formed on the sidewalls of said U-shaped channel;

said projections having grooves therein positioned to mate with said marginal flanges, camming surfaces slidably engagable with the camming surfaces of said camming flanges, and detent locking surfaces engagable with the detent locking lips of said camming flanges.

13. An intermediate horizontal mullion for use in a wall framing system comprising:

a generally U-shaped channel member having panel engaging means on the exterior of one leg of the "U";

the legs of said channel member being substantially equal in length to the overall thickness of said mullion;

and said channel member further having joint forming flange means extending from the base of the "U" into the interior thereof;

the extension of said flange means being less than the height of the legs of the "U";

in which said joint forming flange means comprise a pair of spaced upstanding parallel flanges each having an inverted "L" shape with the bases of the "L's" facing each other.

* * * * *